US009989198B2

(12) United States Patent
Chen

(10) Patent No.: US 9,989,198 B2
(45) Date of Patent: Jun. 5, 2018

(54) REPLACEMENT LED LIGHT MODULE

(71) Applicant: Michael Chen, Whittier, CA (US)

(72) Inventor: Michael Chen, Whittier, CA (US)

( * ) Notice: Subject to any disclaimer, the term of this patent is extended or adjusted under 35 U.S.C. 154(b) by 112 days.

(21) Appl. No.: 15/158,132

(22) Filed: May 18, 2016

(65) Prior Publication Data

US 2017/0336033 A1 Nov. 23, 2017

(51) Int. Cl.

| | |
|---|---|
| ***F21K 9/232*** | (2016.01) |
| ***F21S 8/02*** | (2006.01) |
| ***F21V 29/70*** | (2015.01) |
| ***F21V 23/00*** | (2015.01) |
| ***F21V 21/096*** | (2006.01) |
| ***F21V 3/00*** | (2015.01) |
| ***F21V 9/08*** | (2018.01) |
| *F21Y 101/00* | (2016.01) |

(52) U.S. Cl.

CPC ..... *F21K 9/232* (2016.08); *F21S 8/026* (2013.01); *F21V 3/00* (2013.01); *F21V 9/08* (2013.01); *F21V 21/096* (2013.01); *F21V 23/001* (2013.01); *F21V 23/005* (2013.01); *F21V 29/70* (2015.01); *F21Y 2101/00* (2013.01)

(58) Field of Classification Search

CPC ... F21K 9/232; F21K 9/23; F21K 9/20; F21V 29/70; F21V 3/00; F21V 9/08; F21V 21/096; F21V 23/001; F21V 23/005; F21V 15/00; F21V 17/10; F21V 17/105; F21V 17/12; F21V 19/003; F21V 19/0055; F21V 29/503; F21S 8/026; F21Y 2101/00

See application file for complete search history.

(56) References Cited

U.S. PATENT DOCUMENTS

| | | | | |
|---|---|---|---|---|
| 4,757,188 | A * | 7/1988 | Nakarai | G06K 7/14 235/454 |
| 8,167,468 | B1 * | 5/2012 | Olsson | F21S 8/03 362/101 |
| 8,172,434 | B1 * | 5/2012 | Olsson | B63B 45/00 362/241 |
| 8,398,266 | B2 * | 3/2013 | Wang | F21V 3/00 362/249.02 |
| 2013/0043781 | A1 * | 2/2013 | Wang | F21V 21/096 313/46 |
| 2015/0079884 | A1 * | 3/2015 | Buxton | B24B 5/363 451/426 |

* cited by examiner

*Primary Examiner* — Bao Q Truong

(74) *Attorney, Agent, or Firm* — Tommy S F Wang; Wang IP Law Group, P.C.

(57) ABSTRACT

The present invention relates to a replacement LED light module with a plurality of LED lights on a PCB board is attached to a heat sink, providing good heat dissipation and provide an easy installation mechanism using magnetic supports that can be quickly put in place to difficult locations, such as ceiling, where there is suitable magnetic flat surface for the magnetic attraction to take effect. The power wires, along with the wire nuts, provide a sort of "back up" tensile support in the event where the magnetic connection may lose its pulling power.

4 Claims, 3 Drawing Sheets

REPLACEMENT LED LIGHT MODULE

FIELD AND BACKGROUND OF THE INVENTION

The present invention relates to LED lighting equipment and fixtures, especially for replacing lighting equipment and/or fixtures that are mounted to the ceiling, providing general lighting to an indoors space.

Lighting fixtures, from traditional incandescent light bulbs, to florescent tubes, to halogen lights, to compact florescent lights, and to the more modern LED lights, need replacement from time to time, either for practical reason of the light being broken, or for decorative purpose of putting on new type of light with different lumen levels or color tones, or for power saving purpose.

Other than changing the power line connections, there is certain complexity involved in changing out the existing light. For example, in a ceiling junction box, or other locations of a structure where lighting fixture is installed, screws or different mechanism may need to be unscrewed, opened or otherwise detached, before the to-be-replaced light fixture can be removed.

When the new replacement light unit(s) is/are put in place, a person needs to go through the reverse installation process of, for example, putting the screws in the right places, tighten the screws, or putting the corresponding mechanism in place, to secure the new light in place.

In the case of replacing ceiling light fixture, this takes a rather lengthy period of time.

Present invention provides a LED light module that substantially shortens the time needed for installing the new replacement light, resulting in cost saving of the labor needed.

SUMMARY OF THE INVENTION

Present invention disclosed a replacement LED lighting module that is suitable for easily changing out a light previously installed in ceiling, or other difficult places.

The replacement LED light module contains a heat sink with a printed circuit board (PCB) attached. The PCB contains the needed driver circuitry to drive some LED lights on the PCB.

Substantial amount of heat generated by the PCB will be dissipated via the heat sink, which is shaped congruently with the PCB.

The range from 10 W to 150 W is generally preferred, for the power consumption rating of such LED lights on a module as described herein.

A cover plate is fixed, at a small gap, to the surface of the PCB, so as to prevent touching the LED driver circuit and the LED lights. The cover plate is generally transparent, but can also have other shades of transparency, or other tints of colors, as preferred by design or consumer requirements.

A plurality of magnet supports extend out from the heat sink. Said magnet supports have sufficient magnet attraction power for making connection to a flat surface with good magnetic property, such as an iron junction box in the ceiling where to-be-replaced old lighting exists.

DESCRIPTION OF THE DRAWINGS

The accompanying drawings, which are incorporated in and constitute a part of this specification, illustrate the preferred embodiments of the invention and together with the description, serve to explain the principles of the invention.

Such drawings are exemplary implementations of the invention as disclosed and are not limiting the scope of the claims as supported by the disclosure made herein.

Figure 1:
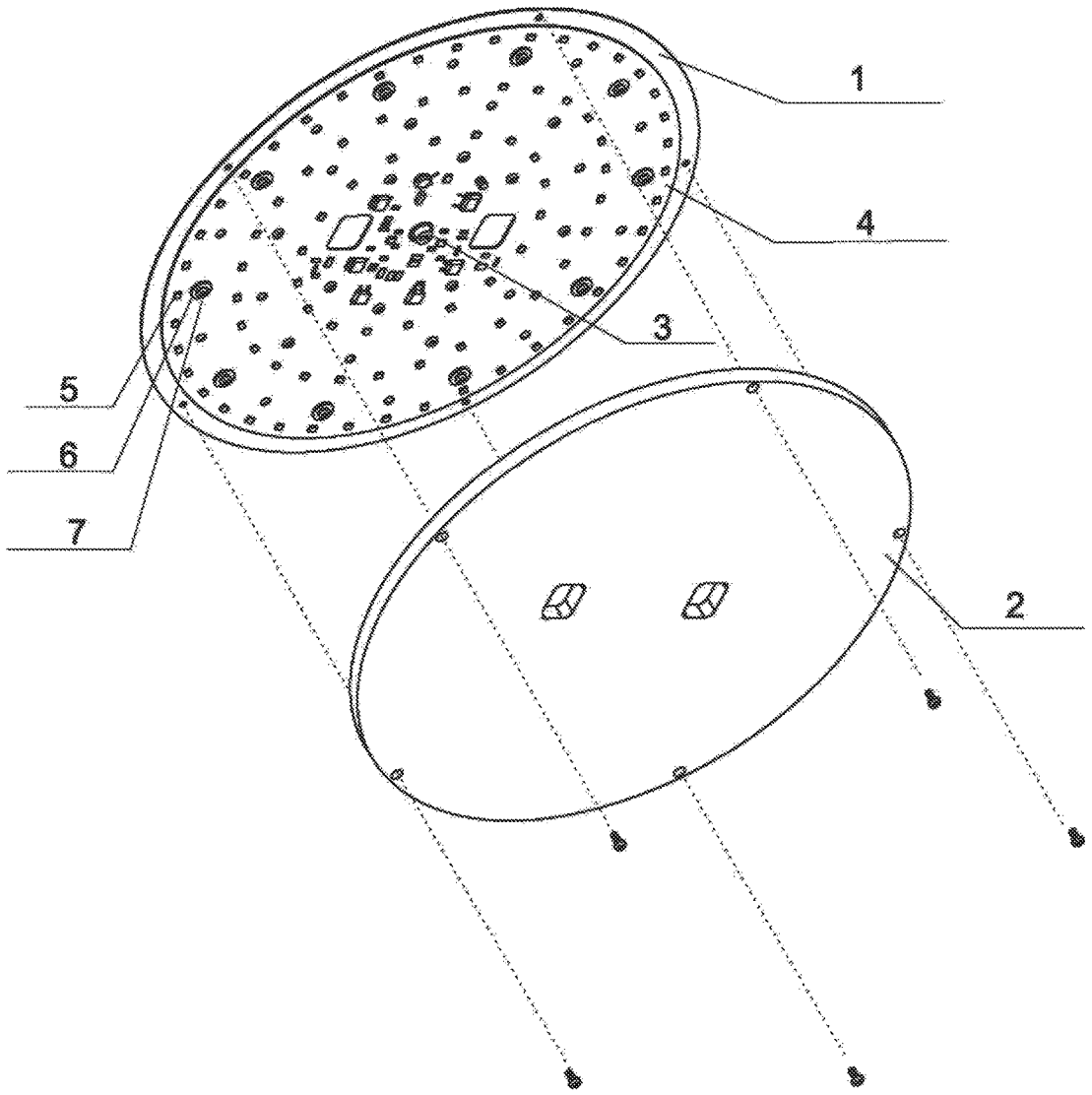

A brief description of the drawings is as follows:

FIG. 1 is an exploded view of the current replacement light module, showing the clear cover away from the PCB/heat sink.

Figure 2:
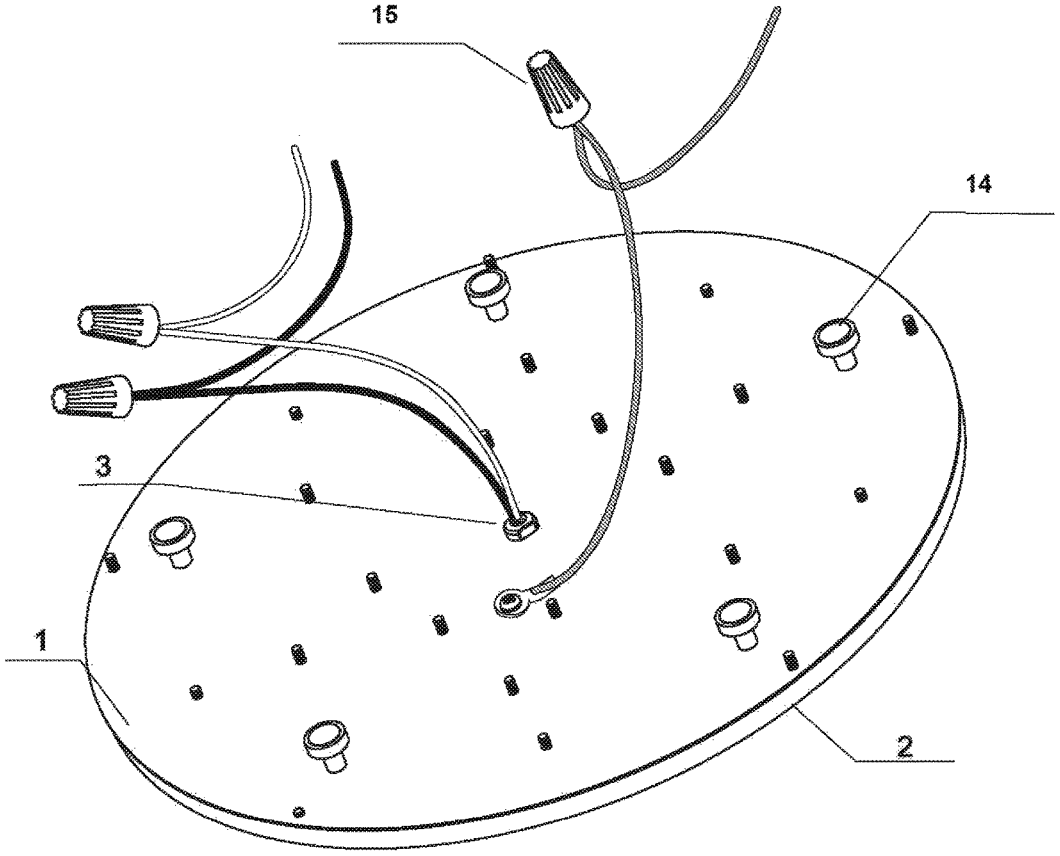

FIG. 2 shows the side of the heat sink with the magnet supports and protruding power wires for connection to the power supply wires.

Figure 3:
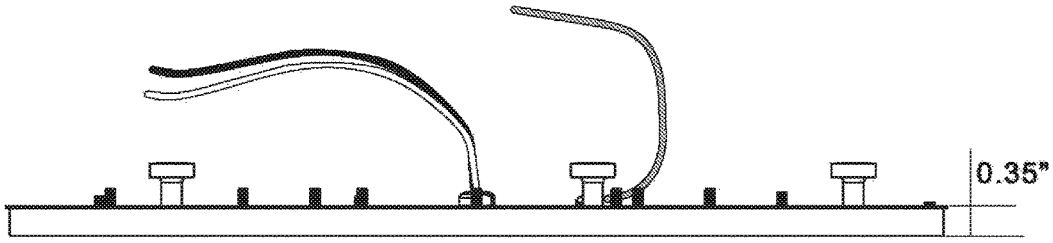

FIG. 3 shows the side profile view of the replacement light module, with a suggested gap between the PCB and the clear cover to be around 0.35 inch.

DETAILED DESCRIPTION OF THE PREFERRED EMBODIMENT

The replacement LED lighting module contains a heat sink 1. The heat sink 1 is generally flat and serves to dissipate the heat generated from a printed circuit board (PCB) 4 with a plurality of LED lights 5 on the PCB 4.

The PCB 4 contains the needed driver circuitry to drive the LED lights 5.

The heat sink 1 and the PCB 4 are generally in a congruent shape.

The plurality of LED lights 5 collectively can have different watt ratings, depending on actual production specification and user requirement. The range from 10 W to 150 W is generally preferred, for the power wattage of such LED lights 5 on a module as described herein.

Power wires are extended out from a wire connector 3.

A plurality of insulated spacers 6 with corresponding mounting screws 7 are situated on the surface of the PCB 4.

A cover plate 2 is fixed, at a small gap, to the surface of the PCB 4, so as to prevent touching the LED driver circuit and the LED lights 5 on the surface of the PCB 4.

The cover plate 2 is generally transparent, but can also have other shades of transparency, or other tints of colors, as preferred by design or consumer requirements.

The small gap between the cover plate 2 and the PCB 4 can have a preferred range of between 0.5 cm and 4 cm.

A plurality of magnet supports 14 extend out from the heat sink 1. Said magnet supports have sufficient magnet attraction power for making connection to a flat surface with good magnetic property, such as an iron junction box in the ceiling where to-be-replaced old lighting exists.

Some wire nuts 15 are used to provide a certain "back up" connection support, in case where the magnet supports lose the attractive pull force and detach from the location of the light installation to be replaced.

As shown in the figures, the wire nuts 15 easily create a physical tensile connection when the power wires from the LED light module are connected to the power lines from the location of the to-be-replaced light, in additional to the electrical connection as intended, to provide the electricity needed to run the LED lights.

What is claimed is:

1. A replacement LED light module comprising, a heat sink;

a PCB having a plurality of LED lights, said PCB is attached to the heat sink;

a wire connector with power wires;

a plurality of insulated spacers with corresponding mounting screws on the PCB;

a cover plate over the PCB, creating a small gap between said cover plate and the PCB; and a plurality of magnet supports extending out from the heat sink, for installation to a generally flat surface that can provide metal contact suitable for magnet attraction; and wire nuts for making a connection to power lines on a location of the installation.

2. The replacement LED light module of claim 1, wherein said wire nuts also provide a tensile support for the replacement light in case in the case where the magnet supports lose the attractive pull force and detach from the location.

3. The replacement LED light module of claim 1, where the cover plate is slightly tinted to add different colors or to soften the light.

4. The replacement LED light module of claim 1, where the collective power wattage of the plurality of the LED lights is between 10 W to 150 W.

* * * * *